US006634456B2

(12) United States Patent
Peng

(10) Patent No.: US 6,634,456 B2
(45) Date of Patent: Oct. 21, 2003

(54) VIBRATING DIAPHRAGM OF FALSE SPEAKER STRUCTURE

(75) Inventor: Jack Peng, Chung Li (TW)

(73) Assignee: Meiloon Industrial Co., Ltd., Taipei (TW)

( * ) Notice: Subject to any disclaimer, the term of this patent is extended or adjusted under 35 U.S.C. 154(b) by 28 days.

(21) Appl. No.: 09/779,656

(22) Filed: Feb. 9, 2001

(65) Prior Publication Data

US 2002/0108806 A1 Aug. 15, 2002

(51) Int. Cl.[7] ..... G10K 13/00

(52) U.S. Cl. ..... 181/171; 181/164; 181/166; 181/168

(58) Field of Search ..... 181/167, 169, 181/171, 172, 173, 165, 166, 128; 381/423, 424, 426, 427, 431

(56) References Cited

U.S. PATENT DOCUMENTS

| | | | | | |
|---|---|---|---|---|---|
| 1,412,619 | A | * | 4/1922 | Knox | 181/169 |
| 1,445,745 | A | * | 5/1923 | Egerton | 181/169 |
| 1,522,311 | A | * | 1/1925 | Kellogg | 181/164 |
| 1,570,337 | A | * | 1/1926 | Cook | 181/168 |
| 1,872,583 | A | * | 8/1932 | Hawley | 181/162 |
| 3,578,104 | A | * | 5/1971 | Sotome | 181/171 |
| 4,635,750 | A | * | 1/1987 | Suzuki | 181/169 |
| 4,646,874 | A | * | 3/1987 | Baitcher et al. | 181/171 |
| 5,425,107 | A | * | 6/1995 | Bertagni et al. | 381/426 |
| 5,615,275 | A | * | 3/1997 | Bertagni | 181/167 |
| 5,682,436 | A | * | 10/1997 | Sakamoto et al. | 381/413 |
| 5,740,264 | A | * | 4/1998 | Kojima | 181/156 |
| 5,744,761 | A | * | 4/1998 | Ogura et al. | 181/171 |
| 5,892,184 | A | * | 4/1999 | D'Hoogh | 181/171 |
| 6,141,430 | A | * | 10/2000 | Imahori et al. | 381/417 |
| 6,176,345 | B1 | * | 1/2001 | Perkins et al. | 181/171 |
| 6,343,136 | B2 | * | 1/2002 | Tokusho et al. | 181/169 |

FOREIGN PATENT DOCUMENTS

| | | | |
|---|---|---|---|
| JP | 57083998 | * | 11/1980 |

* cited by examiner

*Primary Examiner*—Robert E. Nappi
*Assistant Examiner*—Patrick Miller
(74) *Attorney, Agent, or Firm*—Troxell Law Office PLLC

(57) ABSTRACT

A kind of vibrating diaphragm of false speaker structure which includes a center piece with integrated formation directly on a larger outer diameter surface layer body, a connected suspended edge provided at the side way of the surface layer body in circle, and the hardness of the center piece is greater than the surface layer body and a gap reserved at the separation of the formation of the surface layer body and the suspended edge; with this provision, it provides aesthetic and consistence in appearance to the vibrating diaphragm formation, and save the adhesion of the suspended edge and the center piece which reduce the process and lower cost and make the center piece embedded with the product firmly without loosen, meeting various test condition and prolong the service life of the structure in practice.

1 Claim, 5 Drawing Sheets

VIBRATING DIAPHRAGM OF FALSE SPEAKER STRUCTURE

BACKGROUND OF THE INVENTION

1) Field of the Invention

This invention is related to the structural improvement of false speaker, especially the center counterpoise, combined in one with the vibrating diaphragm, enlarge the service life and environmental range, and capable in one formation resulting nicer appearance and easy production of vibrating diaphragm of false speaker improvement.

2) Description of the Prior Art

As shown in FIG. 1, in addition to provide sound output speaker on the speaker box, extra false speaker is required to be mounted at appropriate position in general speaker design to prevent the output of speaker on the box from interference by the compressed air in the confined space, allow the reverse interaction of the vibrating diaphragm of false and real speaker during sound output in order to modulate the volume of the speaker box effectively, make the air inside the speaker box balance the speaker in order to obtain good output, the illustrated is one conventional false speaker, which is basically comprised of one steel frame holder, one vibrating cone and a ring of suspended edge which connect the both together, which is apparently similar to common speaker, the difference of the both is no coil, magnet and spring panel is provided for the false speaker.

The more advanced false speaker structure of prior art is as shown in FIG. 2, it omitted the vibrating cone and changed to a adhesion of suspended edge center to a card board of wooden board of different hardness, in order to reduce material and process, and achieve optimal vibration requirement of speaker by adding center counterpoise and thin and flexible edge, but the drawback of the structure are as follows:

1. Due to non-one formation of the suspended edge and wooden board, thus adhesion is required in construction, the quality is hard to control in addition to poor appearance, and lack of the conoid of the vibrating cone lead to difficult center alignment to the board adhesion and reinforced positioning is required during adhesion.
2. The product is resulting from adhering the wooden board and suspended edge which shorten the service life. Loosen gap is tended to be formed at the adhesion place after prolong vibration and cause hissing noise and affect the output sound quality, and the complete wooden board may falls off and can't not be used.
3. The false speaker prepared in this manner is attaching two types of materials of different hardness, the above stated loosen failure may happen regardless under low and high temperature test condition, the production may subject to material changed under certain condition and tackle by the adhesive formula, leading to extreme limitation to the application range of the product and cause continuous test and improvement in process which cause wastage.

Due to the above fact, the invention conducts constant research and study. Finally, the invention is successful after a series of tests and improvement.

SUMMARY OF THE INVENTION

The primary objective of the invention is to provide a kind of vibrating diaphragm of false speaker with center counterpoise which is capable to combine with the vibrating diaphragm in one with long service life and wide application range, and one formation make good looking in appearance and easy production The secondary objective of the invention is to design effective structure of easy holding center counterpoise which facilitate correct alignment during production and obtains accurate bonding between vibrating diaphragm For the purpose of achieving the above stated target, the vibrating diaphragm of false speaker improvement provided by this invention comprised mainly a kind of improvement to vibrating diaphragm structure of false speaker which included a center plate with an one piece formation directly a larger outer diameter surface layer body, a connected suspended edge provided at the side way of the surface layer body in circle, and the hardness of the center piece is greater than the surface layer body and a gap reserved at the separation of the formation of the surface layer body and the suspended edge; with this provision give aesthetic and consistence in appearance of vibrating diaphragm formation, and save the adhesion of the suspended edge and the center piece which reduce the process and lower cost and make the center piece embedded with the product firmly without loosen, meeting various test condition and prolong the service life of the structure.

The followings are brief description for optimal embodiments of the invention for committee's better understanding in the structure assembly and operations of the invention,

DETAILED DESCRIPTION OF THE PREFERRED EMBODIMENT

Figure 1:
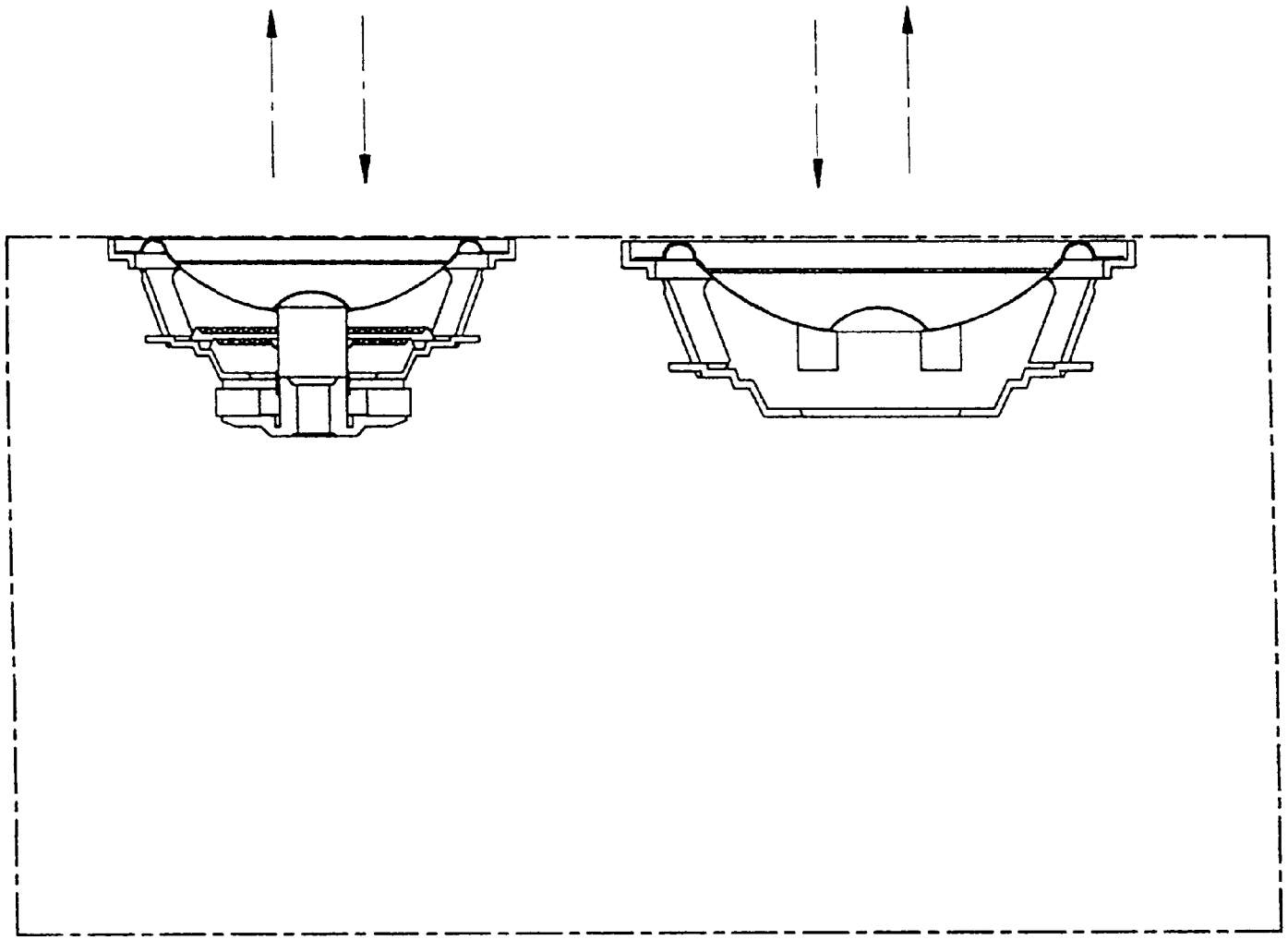
Fig.1 Prior Art
FIG. 1 is an application drawing for the false speaker of the invention of prior art
Figure 2:
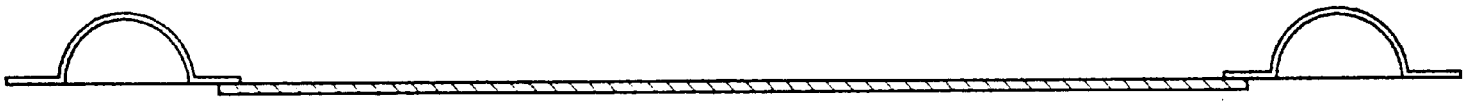
Fig.2 Prior Art
FIG. 2 is a drawing of the plane perspective view of another false speaker of the invention of prior art
Figure 3:
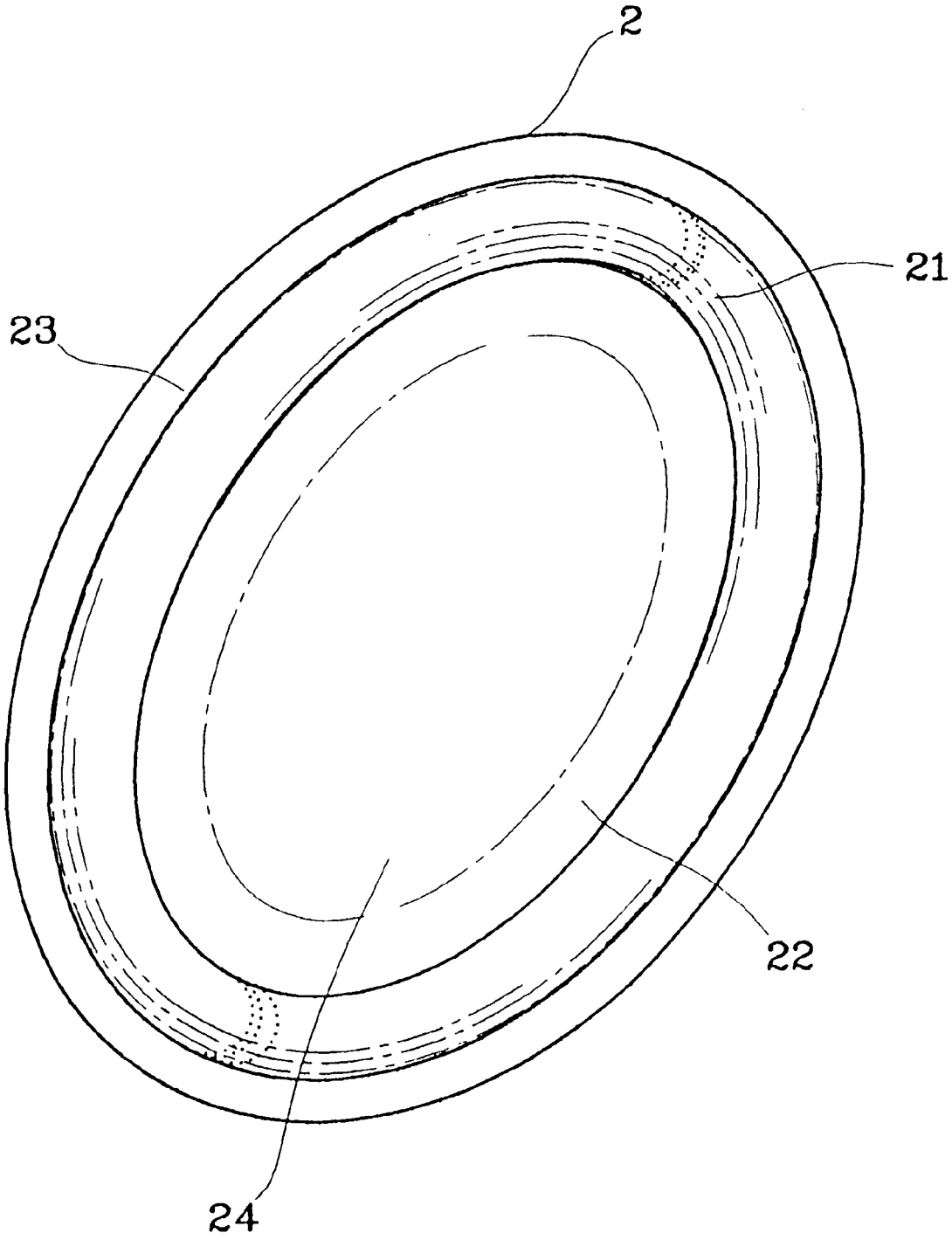
FIG. 3 is an isometric drawing of the invention
Figure 4A:
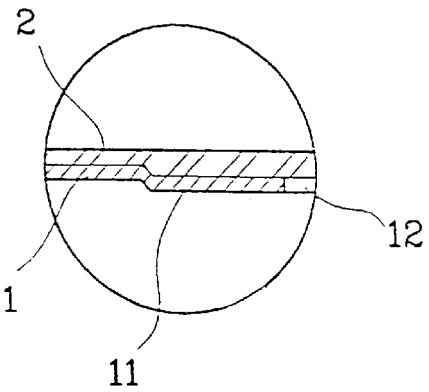
FIG. 4A is an enlarged cross-sectional view of area A in FIG. 4.
Figure 4:
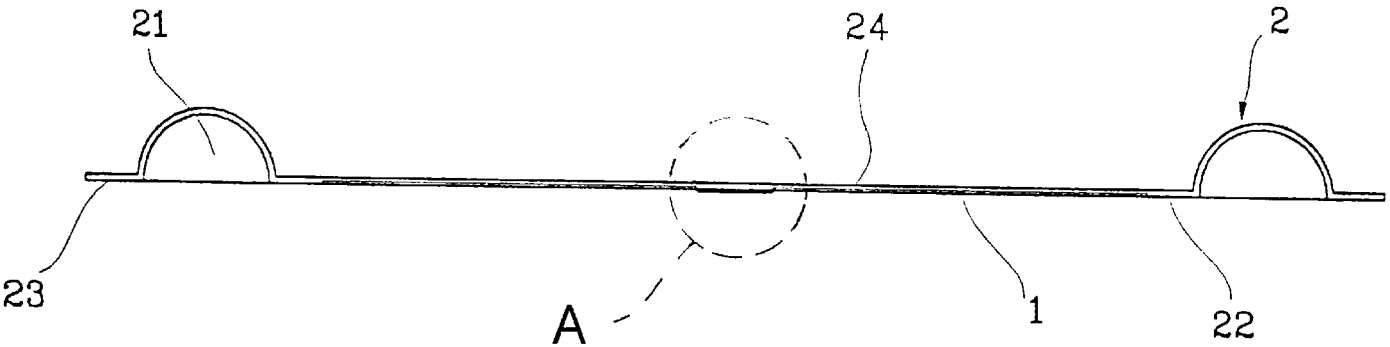
FIG. 4 is a drawing of the plane perspective view of the invention

Refer to FIGS. 3, and 4A, the improvement of the false speaker vibrating diaphragm in this invention is mainly a center plate with a one piece formation directly a larger outer diameter surface layer body 2; among them, the side position of the surface layer body 2 provided with direct ring of connected suspended edge 21, and there is a gap 22 separate the center piece 1 which is harder than the surface layer body formation and suspended edge.

And the surface layer body 2 may be in one formation soft rubber circular plate while implementation, the outer rim possess one ring of lip 23 for adhering the steel frame, internally connect one ring or protruded semi-spherical suspended edge 21, and a spherical plane 24 provided inside; the center piece 1 is concentric metal plate embedded on the rear center of the surface layer body spherical plane, it is partitioned by the suspended edge 21 enclosure and form one ring of speaker vibration buffer elastic area naturally by gap 22.

The new type false speaker vibrating diaphragm formed by soft rubber surface layer body 2 directly on one formation metal center piece, the rigidity of product is good and the weight and thickness of the inner center piece 1 can be selected and adjusted during production with response to different specification condition, and for the convenience of production, a slightly protruded platform 11 can be provided at rear center of the center piece 1, there is holding holes 12 which is facilitate process can be provided.

With the help of these, the seamless joint and good looking appearance can be achieved during formation and assemble of vibrating diaphragm, and no adhesion between suspended edge 21 and center piece body 1, thus it reduces the process and lower cost effectively; besides, the joint position of center piece product is accurate in size and can be embedded into the back of surface layer body 2 properly which promotes the quality and the wide application range will meet various test condition.

Figure 5:
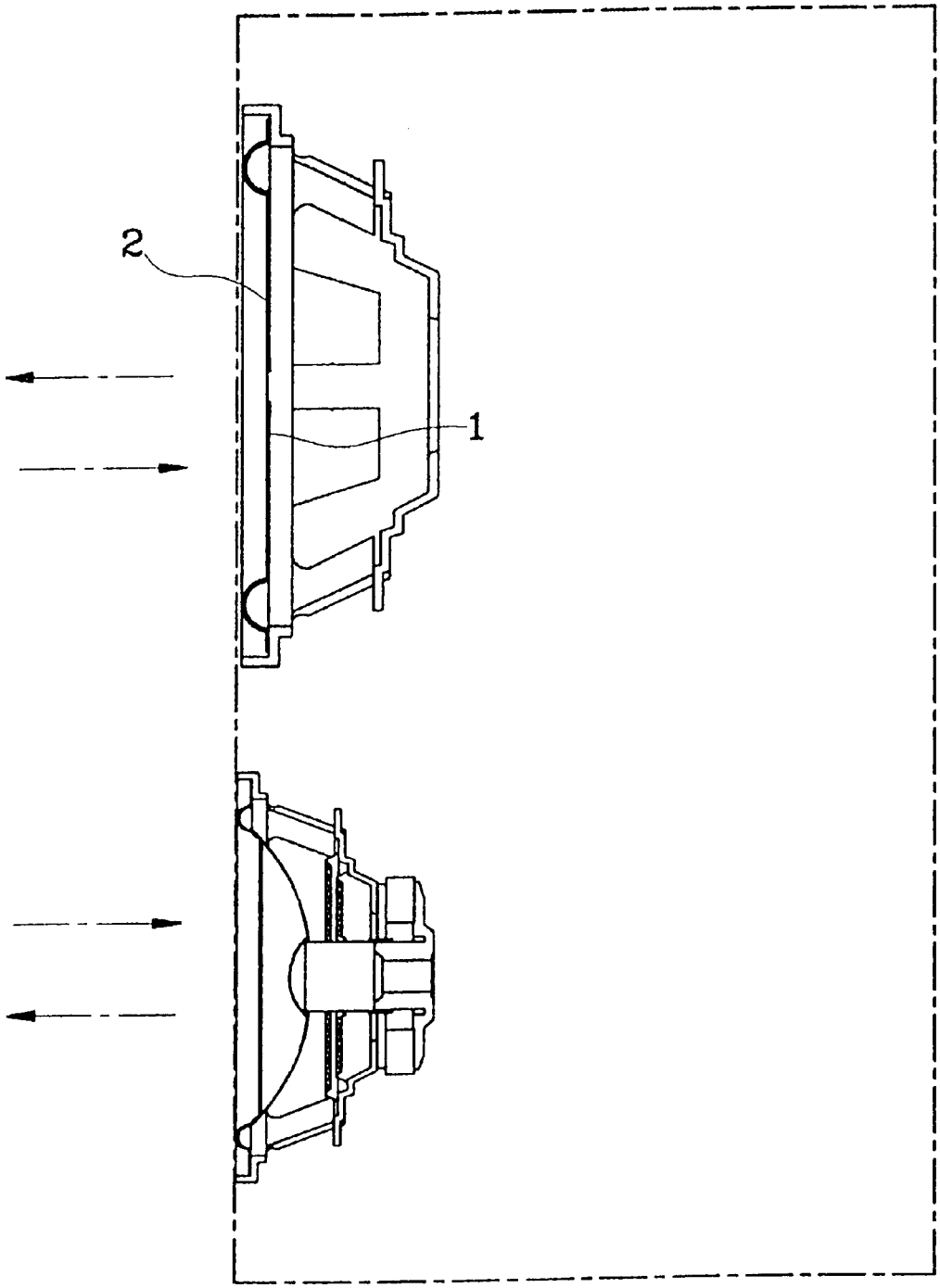
FIG. 5 is an application drawing of this invention.

Application as shown in FIG. 5, among them the center piece body 1 and surface layer body 2 contact closely in one, no loosen will be occurred during vibration and will extend the service life of the false speaker effectively.

The above explanation is a substantial embodiment of the invention, which provides easy production of the vibrating diaphragm of false speaker and promotes the quality effectively, and more durable and advancement. Furthermore, the present invention meets all new patent application requirements and is lawfully submitted for review and the granting of the commensurate patent rights to thereby encourage the spirit of invention and its rightful protection under the patent law.

What is claimed is:

1. A false speaker vibrating structure comprising:

a) a surface layer body made of rubber and including an outermost lip, a semi-spherical ring portion extending inwardly from the outermost lip, a gap portion extending inwardly from the ring portion and a central planar portion extending inwardly from the gap portion;

b) a metal plate embedded in the central planar portion such that a thickness of the combined planar portion and metal plate adjacent to the gap portion is the same as a thickness of the gap portion; and c) a protruding platform in the central planar portion engaging a corresponding depression in the metal plate.

* * * * *